US006377774B1

(12) United States Patent
Maul et al.

(10) Patent No.: US 6,377,774 B1
(45) Date of Patent: Apr. 23, 2002

(54) SYSTEM FOR APPLYING RELEASE FLUID ON A FUSER ROLL OF A PRINTER

(75) Inventors: Michael David Maul; Edward Alan Rush, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/684,930

(22) Filed: Oct. 6, 2000

(51) Int. Cl.[7] ..... G03G 15/20
(52) U.S. Cl. ..... 399/325
(58) Field of Search ..... 399/324–326; 118/60; 432/60

(56) References Cited

U.S. PATENT DOCUMENTS

| | | | | |
|---|---|---|---|---|
| 4,214,549 | A | | 7/1980 | Moser |
| 4,242,566 | A | | 12/1980 | Scribner |
| 4,610,745 | A | | 9/1986 | Sallee et al. |
| 4,805,554 | A | | 2/1989 | McIntyre |
| 4,949,096 | A | | 8/1990 | Ogawa et al. |
| 4,952,944 | A | | 8/1990 | Inui et al. |
| 5,045,890 | A | | 9/1991 | DeBolt et al. |
| 5,049,944 | A | | 9/1991 | DeBolt et al. |
| 5,101,759 | A | | 4/1992 | Hefele |
| 5,114,520 | A | | 5/1992 | Wang, Jr. et al. |
| 5,130,754 | A | | 7/1992 | Hishikawa |
| 5,285,248 | A | | 2/1994 | Menjo et al. |
| 5,327,203 | A | | 7/1994 | Rasch et al. |
| 5,354,612 | A | * | 10/1994 | Miyabayashi ..... 118/60 X |
| 5,420,678 | A | | 5/1995 | Rasch et al. |
| 5,452,065 | A | | 9/1995 | Bell |
| 5,493,375 | A | | 2/1996 | Moser |
| 5,500,318 | A | | 3/1996 | Tanikawa et al. |
| 5,500,722 | A | | 3/1996 | Jacobs |
| 5,576,821 | A | * | 11/1996 | Rasch et al. ..... 399/325 |
| 5,594,540 | A | | 1/1997 | Higaya et al. |
| 5,698,034 | A | | 12/1997 | Clark et al. |
| 5,858,093 | A | | 1/1999 | Saitoh et al. |
| 5,890,047 | A | | 3/1999 | Moser |
| 5,943,542 | A | | 8/1999 | Dalal et al. |
| 5,966,578 | A | | 10/1999 | Soutome et al. |
| 5,978,640 | A | | 11/1999 | Segawa |

* cited by examiner

*Primary Examiner*—William J. Royer
(74) *Attorney, Agent, or Firm*—Todd T. Taylor

(57) ABSTRACT

An oil web system for an imaging apparatus fuser is disclosed, together with its associated method of operation. The oil web system includes an oil web, an applicator roll in contact with a fuser roll, and a transfer station for transferring release oil from the web to the applicator roll. The oil web is advanced along a web path from a supply spool to a take-up spool. The applicator roll rotates against the fuser roll and receives oil from the oil web, and transfers the oil to the fuser roll. The applicator roll may be in direct contact with the web, and receive the oil directly from the web; or a transfer roll may be operated to receive the oil from the web and transfer the oil to the applicator roll.

16 Claims, 3 Drawing Sheets

SYSTEM FOR APPLYING RELEASE FLUID ON A FUSER ROLL OF A PRINTER

BACKGROUND OF THE INVENTION

1. Field of the Invention

The present invention relates to an electrophotographic imaging apparatus, and more particularly to a fuser oiling apparatus and the associated method involved with its use and operation.

2. Description of the Related Art

In the electrophotographic process commonly used in imaging apparatus such as laser printers, an electrostatic image is created upon a photosensitive member such as a roll or belt. Visible electroscopic marking particles, commonly referred to as toner, are applied to the electrostatic image on the photosensitive member. Thereafter, the toner is transferred to the desired media, which may include paper, transparency sheets or the like.

Until the toner is fixed by the application of heat, the toner image applied to the media is not permanent. During fixing, the toner is elevated in temperature sufficiently to cause constituents of the toner to become tacky, and flow into the pores or interstices between fibers of the media. Upon cooling, the toner again solidifies, causing the toner to adhere to the media. Pressure may be applied to enhance the flow of the toner, and thereby improve the subsequent bonding of the toner to the media.

An approach used commonly for thermally fixing an electroscopic toner image includes passing the media, with the toner image thereon, through a nip formed by opposed rolls, at least one of which is heated either internally or externally such that the roll surface is at an elevated temperature. The heated roll, referred to as a fuser roll, contacts the toner image, thereby heating the image within the nip. Under some operating conditions, the tackiness of the toner upon heating can cause the mediator adhere to the fuser roll and/or may cause a build up of toner on the fuser roll. By controlling the heat transfer to the toner, transfer of toner to the user roll can be minimized. In a duplex imaging apparatus, wherein both sides of the media may be printed, toner transfer or media sticking problems may be enhanced. Further, toner may be transferred to the backing roll of the fuser roll couple, and transferred thereafter elsewhere in the apparatus. The presence of wayward toner particles in the imaging apparatus can degrade the quality of the printed sheets.

Fuser of the type described above commonly employ an apparatus for applying a release fluid to the surface of the fuser roll. The release fluid creates a weak boundary between the heated roll and the toner, thereby substantially minimizing the offset of toner to the fuser roll, which occurs when the cohesive forces in the toner mass are less than the adhesive forces between the toner and the fuser roll. Silicone oils having inherent temperature resistance and release properties suitable for the application are commonly used as release fluids. Polydimethylsiloxane is a silicone oil that has been used for this purpose advantageously in the past.

Various methods and apparatuses have been used to supply oil to the fuser hot roll, including oil wicking systems, oil delivery rolls, and oil webs. Oil wicking systems include reservoir tanks of the desired release agent or oil, and a piece of fabric wick material having one end mounted in the reservoir and the other end spring biased against the hot roll. Oil from the reservoir is drawn through the fabric wick by capillary action, and is deposited against the roll surface. While a wicking system can be effective in supplying oil to the fuser roll, surface deposit of the oil on the roll can be inconsistent, and the replenishment or replacement of the oil and/or system can be difficult and messy.

A variety of oil delivery roll systems have been used in the past, and include a roll nipped against the hot fuser roll. The oil delivery roll may be either freely rotating against the fuser roll or driven against the roll through a gear train. Oil delivered to the surface of the oil delivery roll is deposited on the hot fuser roll as the rolls rotate against each other. Various structures have been used for providing oil to the surface of the oil delivery roll, including reservoirs at the center of the roll providing oil to the surface through small dispersal holes or via capillary action through the outer material. Felts or metering membranes may be used in the oil delivery roll to control the oil flow through the roll. Another style of such roll is referred to as a web wrapped roll, and includes high temperature paper or non-woven material saturated with oil, and wrapped around a metal core. In yet another type of oil delivery roll, the roll rotates in a vat or reservoir of release oil, picking up a coating of the oil or release agent, which is then, in turn applied to the fuser roll. It is also known to use a roll couple in applying the oil from the vat onto the fuser roll. A first pickup roll rotates in the oil contained in the vat and is nipped against an applicator roll. The applicator roll is nipped against the fuser roll. Oil picked up by the pickup roll is transferred to the applicator roll, and is subsequently transferred to the fuser roll. Doctor blades may be used to remove excess oil from the pick-up roll. Arrangements of this type can suffer from similar problems of resupply and cleanliness as oil wicking systems.

Oil web systems include a supply spool of web material, generally being a fabric of one or more layers saturated with the desired oil. A take-up spool is provided for receiving the used web. A web path, commonly including one or more guide rolls, extends from the supply spool to the take-up spool. A portion of the web path brings the web material into contact with the hot fuser roll, either by wrapping a portion of the web around the hot roll, or by utilizing a spring-biased idler roll to nip the web material against the hot roll. As the hot roll rotates against the web in contact therewith, oil is transferred from the web to the fuser roll. Periodically, a drive mechanism for the take-up spool activates, rotating the take-up spool and advancing web material from the supply spool to the take-up spool, thereby bringing a fresh section of web material into contact with the fuser roll.

Oil web systems can be used to deliver oil with good uniformity across the fuser roll surface. However, the texture of the oil web makes the web abrasive. As the fuser roll rotates against the oil web, the oil web can cause degradation of the fuser roll surface. Any surface irregularities on the fuser roll can lead to print quality reduction. Minimizing the abrasive quality of the web, while retaining the required properties for oil retention and subsequent oil transfer can be done only with costly materials, or with multi-layer webs difficult and expensive to manufacture, substantially increasing the cost for new or replacement oil web systems.

What is needed is an oil web system for an imaging apparatus fuser drum which retains the advantages of an oil web system, such as cleanliness, ease in replacement and consistency in performance; while eliminating the disadvantages in known oil web systems, such as the abrasive contact between the oil web and the fuser drum.

SUMMARY OF THE INVENTION

The present invention provides an imaging apparatus having an oil web system for applying release oil on the fuser roll, and an operating method for an oil web system, whereby the abrasive effect of the web against the fuser roll is eliminated.

In one form thereof, the present invention comprises an oil web system having an elongated web with fuser release agent impregnated therein, a supply spool for unused portions of the web, and a take-up spool for used portions of the web. An applicator roll has an outer surface in contact with the fuser roll. A transfer station transfers release agent from the web to the applicator roll.

In a second form thereof, the invention comprises an imaging apparatus, including a fuser having a hot roll, a backing roll and a fuser nip formed between the hot roll and the backing roll. An oil web system is provided, including an applicator roll disposed in contact with the hot roll, a material web having release fluid therein, a supply spool and a take-up spool for the web, and a transfer station operating with the web and the applicator roll to transfer release fluid from the web to the applicator roll, and a web advancement means for advancing the material web between the supply spool and the take-up spool.

In yet another form thereof, the invention comprises a method for applying release fluid onto the surface of a fuser roll, including providing a web of material having release fluid therein, a supply spool for unused portions of the web and a take-up spool for used portions of the web; providing an applicator roll disposed in contact with the fuser roll; transferring release fluid from the web to the applicator roll; and applying release fluid on to the fuser roll with the applicator roll.

An advantage of the present invention is the consistent application of release fluid on the fuser roll.

Another advantage of the present invention is reduced wear on the fuser roll.

Yet another advantage of the present invention is the elimination of the abrasive contact between the fuser roll and the oil web.

A further advantage of the present invention is increased expected operating life for the fuser roll.

BRIEF DESCRIPTION OF THE DRAWINGS

The above-mentioned and other features and advantages of this invention, and the manner of attaining them, will become more apparent, and the invention will be better understood by reference to the following description of the embodiments of the invention, taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
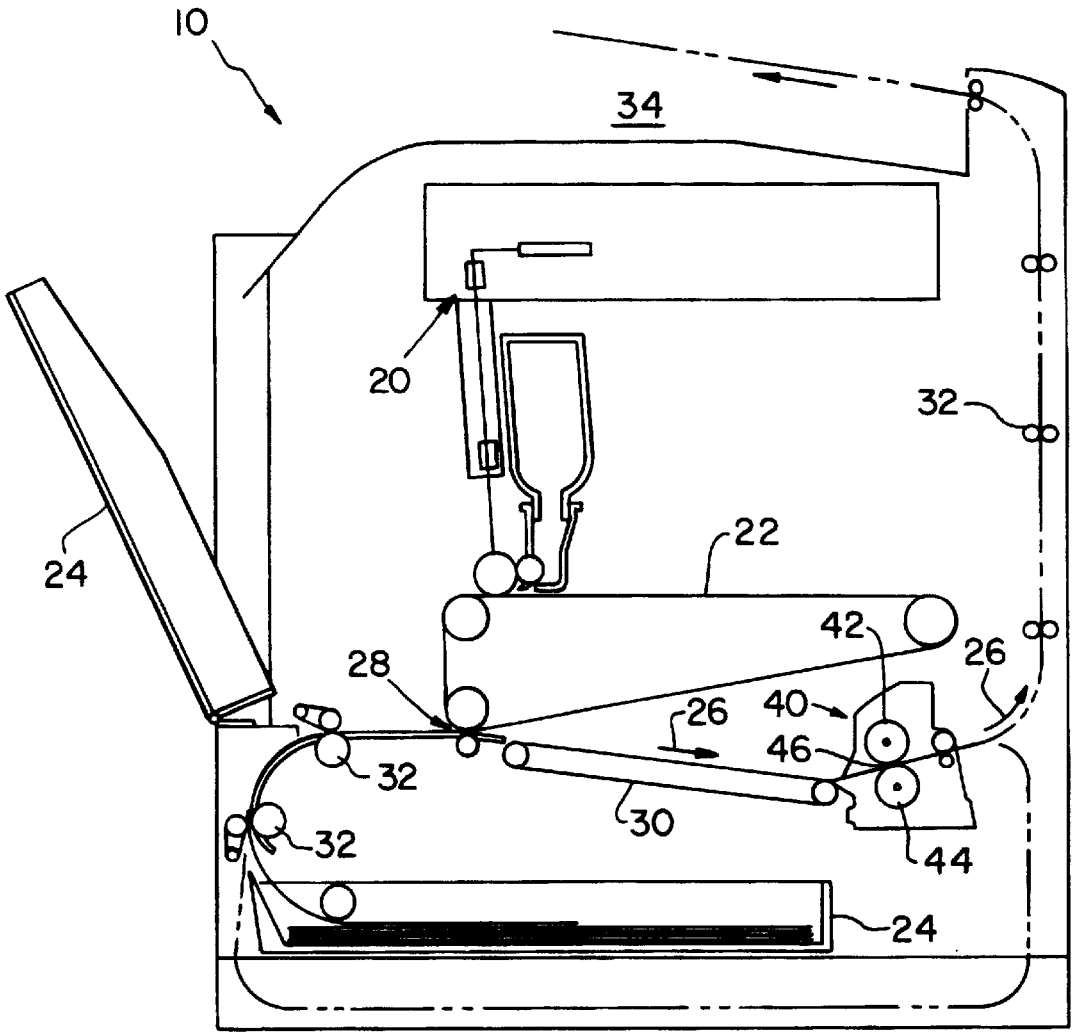
FIG. 1 is a simplified schematic representation of a laser printer in which the present invention may be utilized advantageously.
Figure 2:
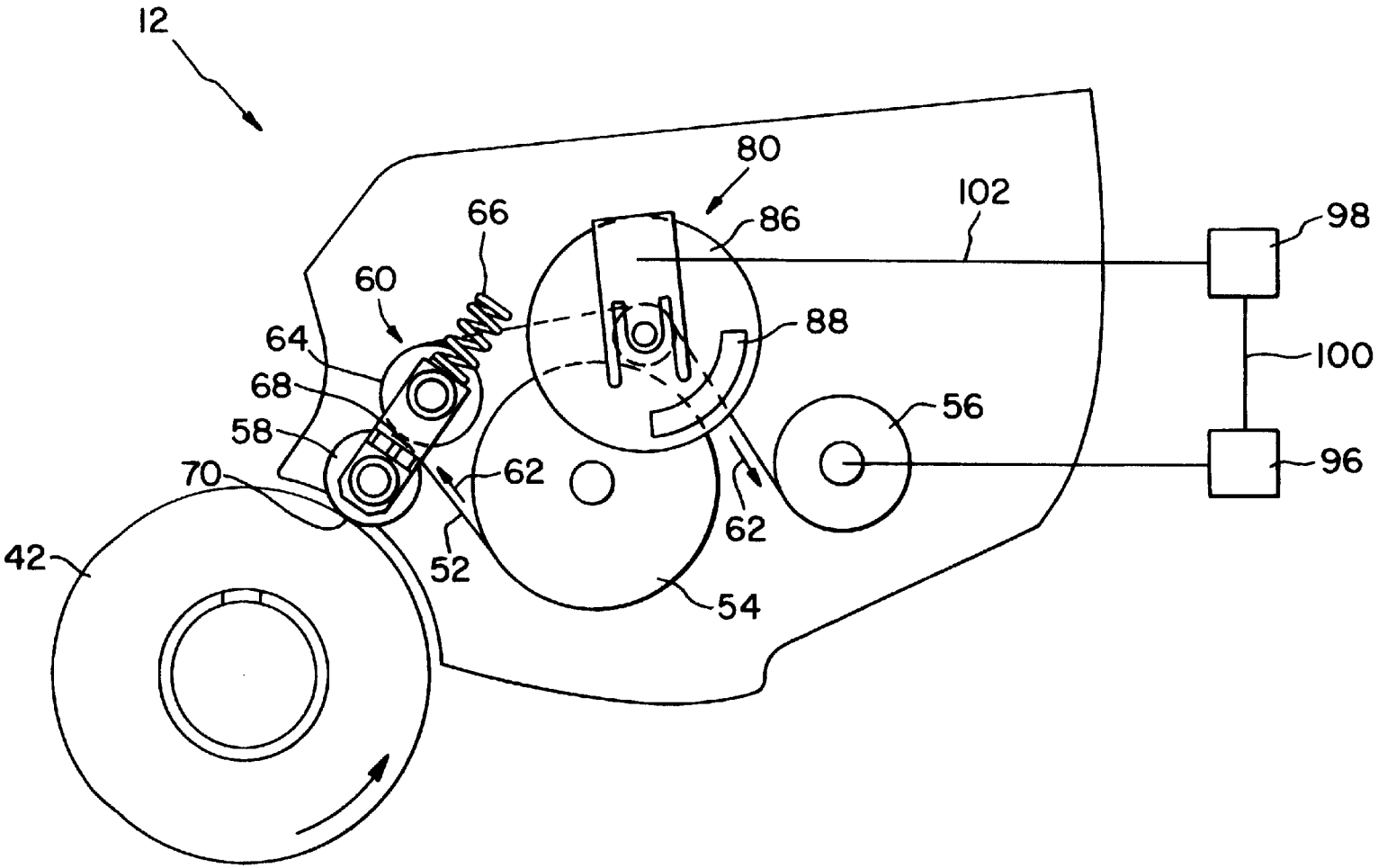
FIG. 2 is a schematic representation of an oil web system according to a preferred form of the present invention.

Referring now more specifically to the drawings, and to FIG. 1 in particular, numeral 10 designates an imaging apparatus in the form of a laser printer, in which an oil web system 12 of the present invention, shown in FIG. 2, may be used advantageously.

Laser printer 10, shown in FIG. 1, is merely one type of imaging apparatus in which the present invention may be used advantageously. Other types of imaging apparatuses, including other types and configurations of laser or other printers, may readily employ use of the present invention to achieve the advantages incumbent therein. The particular embodiment of the laser printer shown in FIG. 1 should not be construed as a limitation on the use and application of the present invention, nor on the scope of the claims to follow.

Laser printer 10 includes a laser printhead 20, which creates an electrostatic image in known fashion on a photosensitive member. Toner is applied to the electrostatic image. It should be understood that in a non-color printer only one printhead may be used; however, in a color printer separate printheads for black, magenta, cyan and yellow toners may be used. The toner image is created on a photoconductive drum and/or image transfer belt 22, and thereafter transferred to the selected media. The media, such as paper or the like, on which the image is to be printed, is provided from one or more media supply trays 24. In FIG. 1, two such media supply trays 24 are shown. The media follows a media path, generally indicated by arrows 26, from one or the other of trays 24 through an image transfer nip 28, at which the image is transferred from the image transfer belt 22 to the media. Media path 26 may include processing through an associated duplexing side path, for reversing the sheet and bringing the opposite side of the media into image transfer nip 28 in proper orientation for receiving the transfer of an image thereto. Media path 26 is includes a series of guide surfaces or belts 30, and guide rolls 32 to direct the media through the printer 10. A printed media receiving zone 34 is provided at the end of the media path 26, to accumulated the completed pieces of media.

To fix the toner image on the media, a fuser 40 is provided, to apply heat and pressure to the image on the media, thereby causing the toner to melt and flow into the pores or interstices of the media. Fuser 40 includes a hot roll 42 and a backing roll 44 disposed in nipped surface contact, creating a fuser nip 46 through which the media passes. To prevent paper from sticking to hot roll 42, and to minimize toner offset to hot roll 42, oil web system 12 is provided, to apply a release agent, such as silicone oil, to the surface of hot roll 42.

Those skilled in the art will understand readily the structure and operation of a laser printer as thus far described, and further details thereof are not necessary to an understanding of the present invention, and will not be given further herein.

Oil web system 12 includes an elongated material web 52, which has been saturated with the selected release agent to be applied to the fuser hot roll 42. The web material, preferably, is a non-woven fabric of polyester and aramid fibers, such as Nomex® manufactured by and available from DuPont. The release agent may be a silicone oil such as polydimethylsiloxane, which has been used advantageously in the past. Web 52 is provided on a supply spool 54, from which it is dispensed periodically to supply release agent for application on hot roll 42. The used or spent portion of the web 52, from which the release agent has been transferred to the fuser hot roll 42, is accumulated on a take-up spool 56.

In accordance with the present invention, an applicator roll 58 is provided, in rotational contact with hot roll 42. In the preferred structure, applicator roll 58 is a so-called "idling roll", that is, it is not connected to drive means, but is driven only through its contact with hot roll 42. Between supply spool 54 and take-up spool 56, a transfer station 60 is provided, wherein web 52 follows a web path indicated generally by arrows 62, along a portion of which it comes in contact with applicator roll 58. In the structure shown in FIG. 2, a biasing roll 64 is used, loaded by a spring 66 to urge web 52 into contact with applicator roll 58 at an oil transfer nip 68. As applicator roll 58 rotates against web 52 in oil transfer nip 68, release agent from web 52 is transferred to the surface of applicator roll 58. Applicator roll 58 is in engagement with hot roll 42 along an applicating nip 70, wherein oil on applicator roll 58 is applied to hot roll 42.

As shown in FIG. 2, applicator roll 58 and take-up spool 56 rotate relative to each other such that, at oil transfer nip 68, applicator roll 58 and web 52 are moving in opposite directions past each other. In this manner, as applicator roll 58 rotates against web 52, applicator roll 58 creates tension on a segment of web 52 from biasing roll 64 to take-up spool 56, and tension in the wind-up of used portions of web 52 on take-up spool 56. Wound-in tension creates a smoother, cleaner wind-up of web 52 on the take-up spool 56. Additionally, the directional relationship between the movement of web 52 and applicator roll 58 causes a slackening of web 52 between supply spool 54 and biasing roll 64, thereby inhibiting free-wheeling or accidental unwind of web 52 from supply spool 54.

Figure 3:
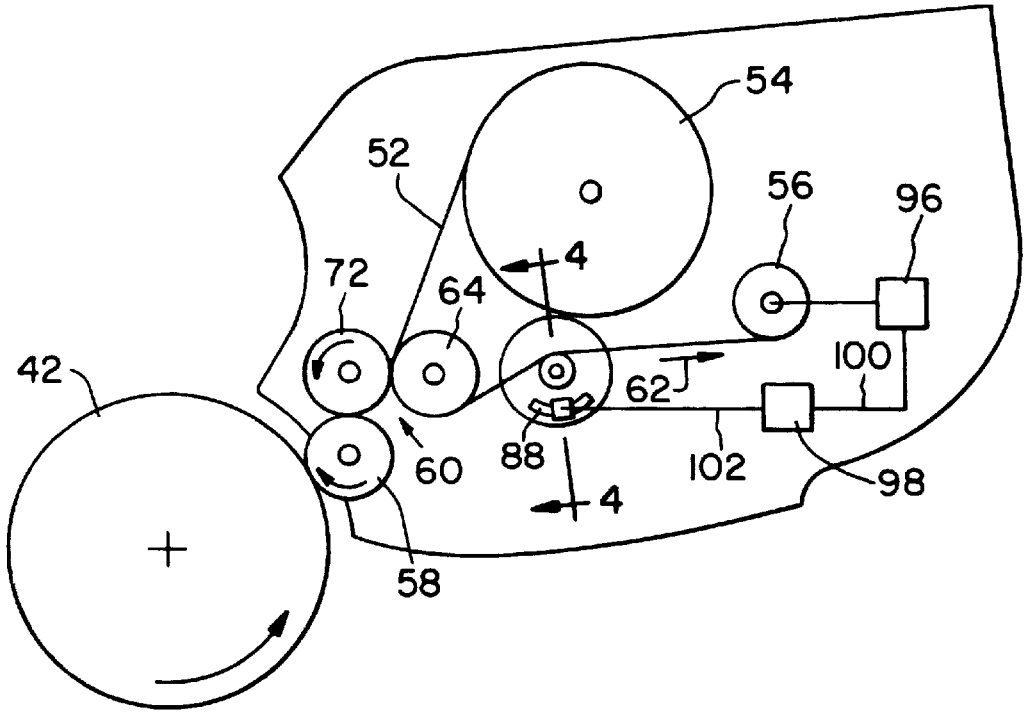
FIG. 3 is a schematic representation of a further embodiment of an oil web system according to the present invention.

To establish the relationship between the direction of travel for web 52 and a roll operating against it, as described above, to prevent free-wheel of web 52, it may be necessary in some configurations to use more than a single roll between web 52 and hot roll 42. One such arrangement is shown in FIG. 3, wherein the relative locations of supply spool 54 and take-up spool 56 are reversed, and the direction of travel of web 52 relative to the rotational direction of hot roll 42 is opposite to that shown in FIG. 2. However, web 52 and applicator roll 58 are not in direct contact. In the embodiment shown in FIG. 3, transfer station 60 includes a transfer roll 72 disposed in surface contact with both web 52 and applicator roll 58. Transfer roll 72 receives oil from web 52 and transfers the oil to applicator roll 58.

Figure 5:
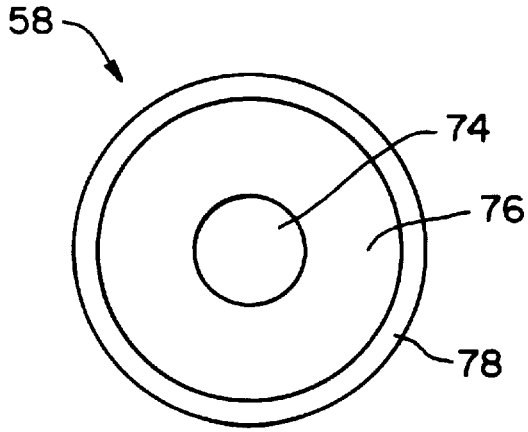
FIG. 5 is a cross-sectional view of an applicator roll of the present invention.

Applicator roll 58, and transfer roll 72 if used, preferably meet certain physical requirements. Each must be capable of transferring silicone oil, must be capable of withstanding high temperatures present in fuser 40 and on the surface of hot roll 42, and should be durable, to last at least as long as web 52. Particularly the surface of applicator roll 58 should not be unduly abrasive, and should be less abrasive than web 52. A roll made of steel, silicone foam or silicone rubber meets these requirements. In a preferred embodiment for the construction of applicator roll 58, shown in FIG. 5, which may also be used for transfer roll 72, a support shaft 74 has a silicone rubber layer 76 thereon. The outer surface of silicone rubber layer 76 includes a coating 78 of a fluoropolymer, such as polyfluoroaniline (PFA) or polytetrafluoroethylene (PTFE). Coating 78 also may be a fluoroelastomer such as that manufactured by, and available from DuPont Dow Elastomers under the name VITON®. Fluoropolymers such as these will enhance the transfer of silicone release oil, by inhibiting the absorption thereof, which could adversely affect transfer rates.

While biasing roll 64 has been shown and described for bringing web 52 into contact with applicator roll 58 (FIG. 2), it should be understood that other arrangements for web path 62 may be used as well. For example, two spaced idler rolls may be used, positioned closely to applicator roll 58, or transfer roll 72, such that web 52 partially wraps applicator roll 58, or transfer roll 72, along the portion of the web path between the idler rolls. Alternatively, a single idler roll could be used, with the idler roll and take-up spool 56 positioned in a manner to provide the same relationship, that is a segment of the web wrapping a portion of applicator roll 58, or transfer roll 72, between the idler roll and take-up spool 56. Web guiding surfaces other than idler rolls may be used to define the web path.

Figure 4:
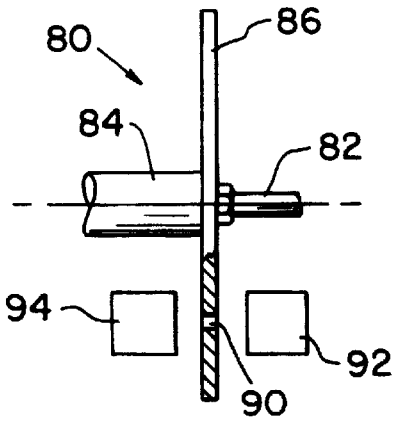
FIG. 4 is a cross-sectional view of the oil web system shown in FIG. 3, taken along line 4—4 of FIG. 3.

A web advancement sensor system 80 (FIG. 4) is provided. Sensor system 80. includes an idler shaft 82, properly journaled in bearings, low friction bushings or the like (not shown). A web engagement portion 84 of shaft 82, such as a sleeve, boss, shoulder portion of the shaft, or the like, is positioned to be in contact with, and partially wrapped by web 52. Typically, web advancement sensor system 80 will be disposed along that segment of web path 62 between take-up spool 56 and biasing roll 64, that segment along which there is tension in the web material. Since web 52 partially wraps and thereby engages engagement portion 84, as web 52 is advanced along path 62, idler shaft 82 of the web advancement sensor system 80 is rotated in direct proportion to the linear movement of web 52.

An encoder wheel 86 is disposed on idler shaft 82 or engagement portion 84, for rotation therewith. Encoder wheel 86 includes surface indicia, holes or the like, movement of which may be detected by an appropriate sensor. In the embodiment shown, a band or region 88 (FIG. 2 or FIG. 3) is provided near the periphery of the encoder wheel 86. Within band or region 88, a hole or opening 90, or a plurality thereof are provided, and may be in specific patterns or orientations. Although band or region 88 is shown as only a segment on wheel 86, region 88 may extend along a greater portion or entirely around the encoder wheel 86, near the periphery thereof. A transmissive sensor, including an emitter 92 which, in known fashion, will emit a beam of light, or the like, and a receiver 94 to receive the emitted beam, is used to detect movement of encoder wheel 86, as evidenced by the passing of the openings 90 of region 88 through the zone between emitter 92 and receiver 94. The structures and operations of appropriate sensors that may be used in the present invention, to ascertain the pattern or frequency of hole passings are well-known for other uses, and will not be described in further detail herein.

Other types of web movement sensors may be used advantageously in the present invention. The encoder wheel and transmissive sensor shown and described are not the only suitable sensors, but are a preferred, low cost and accurate alternative.

To effect transfer of the web 52 from the supply spool 54 to the take-up spool 56, a drive mechanism 96 is provided, which may include an independent, dedicated prime mover and gear train, a gear train from a common drive for other apparatus in the printer, or the like. The prime mover may be a stepper motor, a solenoid, or other positional actuator. Such drive mechanisms are well known in the industry, and will not be described in further detail herein. Operation of drive mechanism 96 is controlled by drive control 98, which may include a microprocessor transmitting signals to drive mechanism 96, including start and stop signals, along a signal pathway 100. Microprocessor 98 receives data from web advancement sensor system 80 along a signal pathway 102.

In the use and operation of an oil web system 12 according to the present invention, as hot roll 42 rotates during use of printer 10, applicator roll 58 is driven by the surface contact between hot roll 42 and applicator roll 58. As applicator roll 58 is rotated against web 52, release oil contained in web 52 is transferred to the surface of applicator roll 58. Rotation of applicator roll 58 by hot roll 42 transfers release oil from the surface of applicator roll 58 to hot roll 42. As the release oil contained in that segment of web 52 which is in contact with applicator roll 58 is depleted, periodically, web 52 is advanced from supply spool 54 to take-up spool 56. The frequency of web advancement or indexing is determined by pre-established parameters entered into drive control 98. When the pre-established time interval has passed, drive control 98 activates drive mechanism 96 to rotate take-up spool 56. Web material 52 is drawn from supply spool 54 through oil transfer nip 68, and spent a 15 web is wrapped onto take-up spool 56. As web 52 is advanced along that segment of web path 62 between biasing roll 64 and take-up spool 56, web 52 passes over and rotates idler shaft 82, in turn rotating encoder wheel 86, providing data to drive control 98 regarding actual linear advancement of web 52.

In the embodiment shown in FIG. 3, applicator roll 58 and transfer roll 72 are in surface contact, and hot roll 42 driving engagement with applicator roll 58 results also in the rotation of transfer roll 72. Release oil from web 52 is deposited on the surface of transfer roll 72, from which it is picked up on the surface of applicator roll 58. Thereafter, the release oil is applied to hot roll 42 by applicator roll 58.

The present invention retains the advantages of an oil web system, including accuracy and consistency in oil application relative cleanliness, ease of maintenance, etc. However, by eliminated direct contact between the web and the fuser roll, the surface degradation of the fuser roll caused by abrasion is reduced. Even if the abrasive nature of the web causes surface degradation of the applicator roll or the transfer roll, print quality is not adversely affected to any significant degree. Fuser roll life expectancy is increased.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An oil web system in an imaging apparatus fuser having a fuser roll, the oil web system comprising:

an elongated web having fuser roll release agent impregnated therein;

a supply spool for holding an unused portion of said web;

a take-up spool for holding a used portion of said web;

an applicator roll having an outer surface disposed in contact with said fuser roll; and a transfer station for transferring release agent from said web to said applicator roll.

2. The oil web system of claim 1, wherein said transfer station includes web guiding members defining a web path from said supply spool to said take-up spool, said web path including a portion in which said web is held in contact with said applicator roll.

3. The oil web system of claim 1, wherein said applicator roll includes a layer of one of steel, silicone foam and silicone rubber.

4. The oil web system of claim 1, wherein said applicator roll includes an outer coating of a fluoropolymer.

5. The oil web system of claim 4, wherein said fluoropolymer is selected from a group consisting of polytetrafluoroethylene, polyfluoroaniline and fluoroelastomers.

6. The oil web system of claim 1, in which said transfer station includes a transfer roll operatively disposed between and in contact with said web and said applicator roll.

7. An imaging apparatus comprising:

a fuser having a hot roll, a backing roll and a fuser nip formed between said hot roll and said backing roll;

an oil web system including an applicator roll disposed in contact with said hot roll, a material web having release fluid therein, a supply spool and a take-up spool for said material web, and a transfer station operating with said material web and said applicator roll to transfer release fluid from said web to said applicator roll; and a web advancement means for advance said material web between said supply spool and said take-up spool.

8. The imaging apparatus of claim 7, wherein said transfer station includes web guiding members defining a web path from said supply spool to said take-up spool, said web path including a portion in which said material web is held in contact with said applicator roll.

9. The imaging apparatus of claim 8, including a spring-loaded biasing roll urging said web against said applicator roll.

10. The imaging apparatus of claim 9, wherein said applicator roll includes a layer of one of steel, silicone foam and silicone rubber.

11. The imaging apparatus of claim 9, wherein said transfer station includes a transfer roll operatively disposed between and in contact with said material web and said applicator roll.

12. The imaging apparatus of claim 7, wherein said web advancement means includes a drive mechanism for rotating said take-up spool, a drive control for supplying start and stop signals to said drive mechanism, and a web advancement sensor system supplies signals to said drive control indicative of actual web advancement.

13. The imaging apparatus of claim 12, wherein said web advancement sensor system includes an idler shaft disposed in contact with said material web and rotated by advancement of said material web, and a encoder wheel operated by rotation of said idler shaft.

14. A method for applying release fluid onto the surface of a fuser roll, comprising the steps of:

proving a web of material having release fluid therein, a supply spool for unused portions of the web, and a take-up spool for used portions of the web;

providing an applicator roll disposed in contact with the fuser roll;

transferring release fluid from the web to the applicator roll; and applying release fluid on to the fuser roll with the applicator roll.

15. The method of claim 14, wherein said transferring step is performed by rotating the applicator roll against the web.

16. The method of claim 14, wherein said transferring step is performed by providing a transfer roll between the web and the applicator roll, and rotating the transfer roll in contact with the web and with the applicator roll.

* * * * *